US005090435A

United States Patent [19]

Leclercq

[11] Patent Number: 5,090,435

[45] Date of Patent: Feb. 25, 1992

[54] FOLDING SHELTER, SUCH AS A SUNSHADE, SHELTER FOR HIKING OR CAMPING OR SIMILAR

[76] Inventor: Jean-Louis Leclercq, 1, rue Yves-Decugis, F-59650 Villeneuve-d'Asq, France

[21] Appl. No.: 460,963

[22] PCT Filed: Jun. 27, 1989

[86] PCT No.: PCT/FR89/00333

§ 371 Date: Feb. 28, 1990

§ 102(e) Date: Feb. 28, 1990

[87] PCT Pub. No.: WO90/00215

PCT Pub. Date: Jan. 11, 1990

[30] Foreign Application Priority Data

Jun. 28, 1988 [FR] France ..... 88 09102

[51] Int. Cl.[5] ..... E04H 15/28

[52] U.S. Cl. ..... 135/98; 135/113; 135/116

[58] Field of Search ..... 135/98, 99, 113, 116, 135/112

[56] References Cited

U.S. PATENT DOCUMENTS

| | | | |
|---|---|---|---|
| 617,611 | 1/1899 | Strickland | 135/98 X |
| 620,600 | 3/1899 | Mason | 135/98 |
| 3,213,868 | 10/1965 | Forbes | 135/116 X |
| 3,252,469 | 5/1966 | Peake | 135/98 X |
| 4,250,906 | 2/1981 | Rivier et al. | 135/98 X |
| 4,805,654 | 2/1989 | Wang | 135/98 X |
| 4,813,442 | 3/1989 | Haines | 135/98 |
| 4,971,090 | 11/1990 | Uhl | 135/98 |

FOREIGN PATENT DOCUMENTS

| | | | |
|---|---|---|---|
| 926762 | 10/1947 | France | 135/98 |
| 214 | of 1860 | United Kingdom | 135/98 |

*Primary Examiner*—David A. Scherbel
*Assistant Examiner*—Lan Mai
*Attorney, Agent, or Firm*—Kuhn and Muller

[57] ABSTRACT

The invention relates to a folding canopy like a sunshade, shelter for hiking, camping or similar, intended specially to provide protection for an area of ground against storms, sunshine or rain. The shelter (1) consists of a roof held up by a retractable system (3) fitted on a column (4) supported on the ground via a foot (5). The foot (5) has means for extending its radial arms (6) simply through the contact between a sliding ferrule on which the arms (6) are jointed and the ground. The invention concerns manufacturers of industrial sunshades and umbrellas.

8 Claims, 2 Drawing Sheets

FOLDING SHELTER, SUCH AS A SUNSHADE, SHELTER FOR HIKING OR CAMPING OR SIMILAR

The invention is relative to a folding shelter, such as a parasol, a market shelter, a camping shelter or similar, designed especially to protect a surface on the ground against bad weather, sun or rain. Its use is especially suitable for manufacturers of professional parasols or umbrellas.

Itinerant merchants have to protect in every season products and articles for sale while allowing open access for their customers. They must take precautions against the rain as well as the sun and the cover utilized in this sense must be able to be installed and disassembled rapidly, as such it must take up little space during transportation.

At the present time, two types of market shelters exist. First of all, one knows the productions which are related to the tent-type of construction. A rigid structure formed by an assembling of tubes serves as a support for an awning. The advantage of this structure is that it can be in large dimensions and that it offers good firmness. Dismounted, it takes up little room. On the other hand, its disadvantages are found at the level of the very high number of parts to put into play and the time for assembling and disassembling.

In light of the imperfections previously set forth, merchants are showing a trend more and more towards structures in umbrella form, as shown for instance in the document FR-A-2 539 600, which offer the advantage of being very convenient in their operation. The market shelters in umbrella form are made of a canvas roof supported by a retractable brace mounted on the extremity of a support pole which rests on the ground through the intermediary of a leg. Merchants only need to unfold the retractable brace in order to form an efficient roof which protects merchandise from the rain and the sun's rays.

Although decidedly more practical than the assembled tubular structure, the retractable brace nevertheless suffers from some defects. In particular, in order to maintain the vertical pole, one utilizes either a separate heavy base, or legs jointed with three or four branches. Yet, whatever the case may be, these legs or bases are always separated from the pole, as shown for instance in document FR-A-551 218.

In the case of the heavy base, the stability of the ensemble depends upon its weight, but that is reflected in the handling.

In the case of the separated jointed leg, it is necessary to open it in the manner of an inverted umbrella, then to fasten it in an open position and finally to get it to fit into the pole of the cover and to secure it with regard to the legs.

The transporting and putting together of this base or leg are hardly convenient. For example, when the canvas is wet after it rains, the ensemble gets heavier and the merchant has a lot of difficulty in maneuvering the pole, and in putting the leg in place.

In order to complete the stability of such covers, and to avoid deforming the structure during a strong wind, it is necessary to set up special devices, such as ballasting devices attached to the extremity of the ribs forming the structure.

More precisely, one utilizes either a rope or a rigid shroud that is tied on one side to the extremity of the rib and on the other side to the ballasts placed on the ground.

Thus, during the assembling or disassembling of the shelter, it is necessary to go and hook up or unhook respectively the ballasts. Similarly, during the stocking of the folded shelter, the shrouds are thus independent from the structure; or in the case of the ropes, these are rolled up on the extremities of the ribs.

One also knows through document U.S. Pat. No. 3,213,868, a shelter of the umbrella type involving a fold-out leg under the control of a hydraulic or screw jack, allowing the simultaneous handling of the legs and of the umbrella itself, but this construction is complicated, expensive and not automatic.

The principal objective of the present invention is to furnish a foldable shelter such as a parasol, market shelter, camping shelter or similar apparatus, of the retractable brace type which offers a great ease in installation. In particular, the vertical stability of the pole is no longer assured by a leg brought into place but thanks to a leg with automatic unfolding.

Thus, when the pole is in contact with the ground, the leg unfolds itself without any direct intervention. Similarly, when one raises the pole from the ground after unbolting, the leg retracts itself without any outside intervention. Due to this fact, the user is able to maneuver his foldable shelter without assistance.

It must be emphasized that this simplicity of function is not obtained at the detriment of the ensemble's stability. Quite to the contrary, the leg of the pole can be in large dimensions and thus offers a good foundation with slight inconvenience when it is retracted.

Another objective of the present invention is to offer a foldable shelter of the retractable brace type whose unfolding is facilitated by the mechanical structure of the present invention.

In fact, in traditional structures, one makes a locking-ring slide on a central pole, which has the effect of unfolding the ribs through the intermediary of a tie-rod fastened between the locking-ring and the median part of each rib. The effort developed is such that it is usual practice to reduce the control through the intermediary of a cable and returning pulleys.

Another objective of the present invention is to offer a foldable shelter allowing the correction of this inconvenience which clearly permits an opening of the structure with reduced effort.

Moreover, the structure of the brace forming the roof is reinforced in order to distribute more evenly on the ribs the efforts caused by the opening and/or the support of the canvas roofing.

Another objective of the present invention is to furnish a market shelter which disposes of a hooking device of ballasts of integrated ribbing. Thus, the risks of entanglement of the shrouds are avoided.

More particularly, the foldable shelter of the present invention allows a juggling of the shrouds from inside of the structure during the folding of the shelter and an automatic setting up of the shrouds during the unfolding of the roof.

The foldable shelter such as a parasol, market shelter, camping shelter or similar apparatus, according to the invention, designed especially to protect a surface on the ground against bad weather, sun or rain, which is formed of a canvas roof supported by a retractable brace mounted on a pole which rests on the ground through the intermediary of a leg, is characterized by the fact that the leg involves means of unfolding brought into action through simple contact with the ground under the effect of the shelter's weight.

Other objectives and advantages of the present invention will appear in the course of the following description which however, is only given as an indication and is not intended to limit its use.

The invention will be better understood by reading the following description accompanied by the attached sketches in which.

The invention is relative to a foldable shelter such as a parasol, a market shelter, camping shelter or similar apparatus designed especially to protect a surface on the ground against bad weather, sun or rain. It concerns more particularly the manufacturers of parasols, umbrellas and others.

Figure 1:
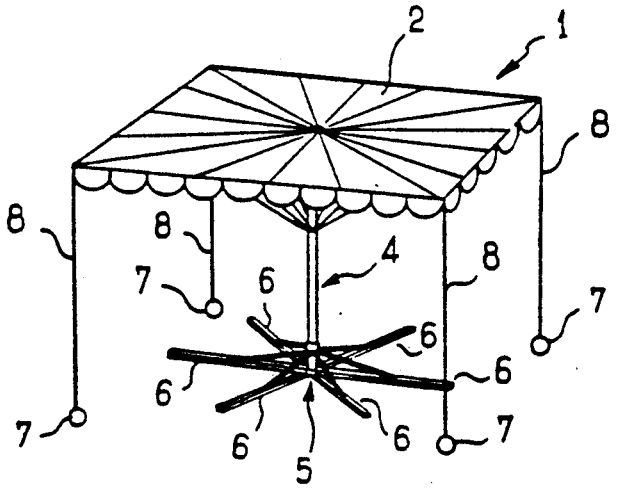
FIG. 1 shows in perspective a foldable shelter according to the invention.

FIG. 1 schematizes retractable cover 1, especially for the market such as envisaged by the present invention. This shelter 1 is formed by a roof 2 in canvas of any form; an elongated form such as rectangular or oval is preferable in order to cover commercial displays. This roof 2 is supported by a retractable brace 3 (FIG. 4), in other words it permits stretching canvas 2 or on the contrary flattening it against a pole of support 4.

Pole 4 rests on the ground through the intermediary of leg 5 formed from a series of branches 6 disposed radially in star formation around pole 4 in order to give good stability, to the shelter.

Moreover, the ballasts 7 are fastened through the intermediary of the shrouds 8 to the extremities of support ribs 16 of canvas 2 in order to avoid the turning inside out of canvas 2 in periods of strong wind.

According to the characteristic principal of the present invention, leg 5 offers means of unfolding brought about through simple contact with the ground under the effect of the shelter's weight. Thus, the user can very easily set up the shelter without any outside assistance, even when the canvas is wet, for it suffices for him to set up the lower extremity of pole 4 against the ground in order that branches 6 of leg 5 unfold themselves and give good vertical stability to the shelter.

In particular, the means of unfolding act under the effect of the weight when pole 4 comes into contact with the ground, the weight of pole 4, of brace 3, and of canvas 2 acting to open leg 5.

Thanks to the invention, the inverse action works as well: during the raising of the pole, the means of unfolding act to retract branches 6 of leg 5 against pole 4.

Figure 2:
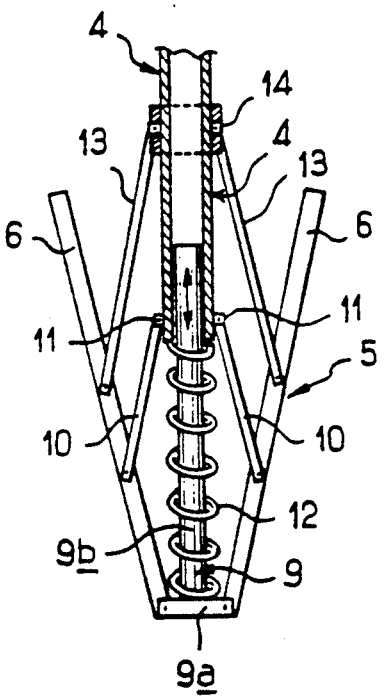
FIG. 2 shows, at a greater scale and in axial outline, the structure of the leg in folded position.

FIG. 2 schematizes leg 5 in retracted position. Leg 5 includes radial branches 6 jointed to the extremity of an axially movable ferrule 9 to the lower extremity of pole 4. Rods 10 jointed to each extremity tie branches 6 of leg 5 to lower part 11 of pole 4. Besides, pull-back device 12, such as a compression spring, pushes back ferrule 9 towards the base, so that branches 6 remain folded against pole 4 in the absence of any outside force. Spring 12 is disposed between the lower extremity of the pole and a head 9 as provided for at the lower extremity of shaft **9*b* of ferrule 9. Should the occasion arise, spring 12 would be able to put in action and mounted to act with overtaking the neutral point, in such a way that it brings leg 5** into an opened and closed position on both sides of this neutral point.

According to the means of use envisaged here, the movable ferrule 9 slides to the inside of tubular pole 4 by its shaft **9*b***.

When one exerts an axial effort towards the top on head **9*a* of ferrule 9, as happens when one places pole 4 noticeably vertically on the ground, one provokes the re-entry of ferrule 9 into tubular pole 4. Spring 12 compresses itself and branches 6 of leg 5 unfold themselves until entering into contact with the ground as is illustrated by example on FIG. 3**.

The unfolding of branches 6 is due to the action of rods 11 which push again branches 6 during re-entry of ferrule 9 into tubular pole 4 against the action spring 12 whose action is just sufficient to assure the normal retraction of the leg (FIG. 2).

One can reinforce the stability of leg 5 by adding supplementary rods 13 jointed on one side to branches 6 and on the other side to ferrule 14 which slides outside along pole 4.

Figure 3:
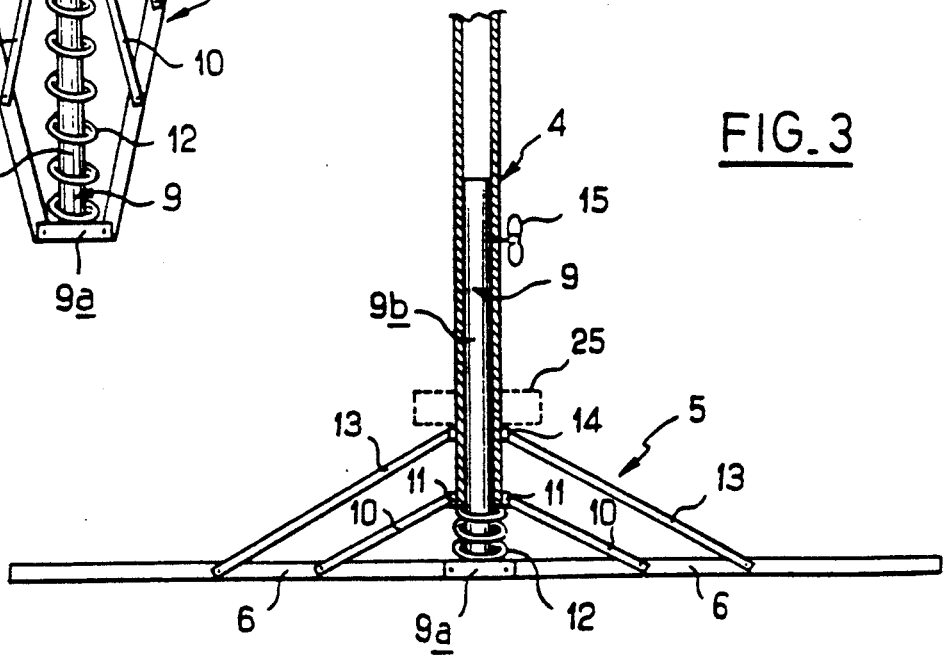
FIG. 3 is a similar view to FIG. 2 for the unfolded position.

In order to avoid any accidental folding of leg 5, one can advantageously provide for a locking mechanism 15 which may for instance reveal itself in the form of a transversal screw or pin, such as illustrated in FIG. 3, which rests against or crosses ferrule 9.

One can equally provide for a locking device of ferrule 14, which presents the double advantage of avoiding the accidental folding of leg 5 and of improving the stabilizing action of complementary rods 13.

Moreover, in order to reinforce the stability of the shelter, one may for instance ballast the leg with the aid of weight 25 represented in dash marks on FIG. 3. Such a ballast can for instance be made up of a heavy torus able to adjust itself around tubular pole 4 and rest itself on ferrule 14. Such ballasting can, in certain cases, render ballasts 7 useless; yet one can use these ballasts as auxiliaries.

According to another characteristic of the invention, the means of unfolding of leg 5 form a movable abutment of opening for retractable brace 3. It concerns a conception of the special retractable brace quite adapted to support canvases of large dimensions.

The popular techniques of construction of parasol or umbrella braces employ only one group of support rods for the ribs, which proves to be insufficient for canvases of large dimensions in the order of 3 m×4 m.

Figure 4:
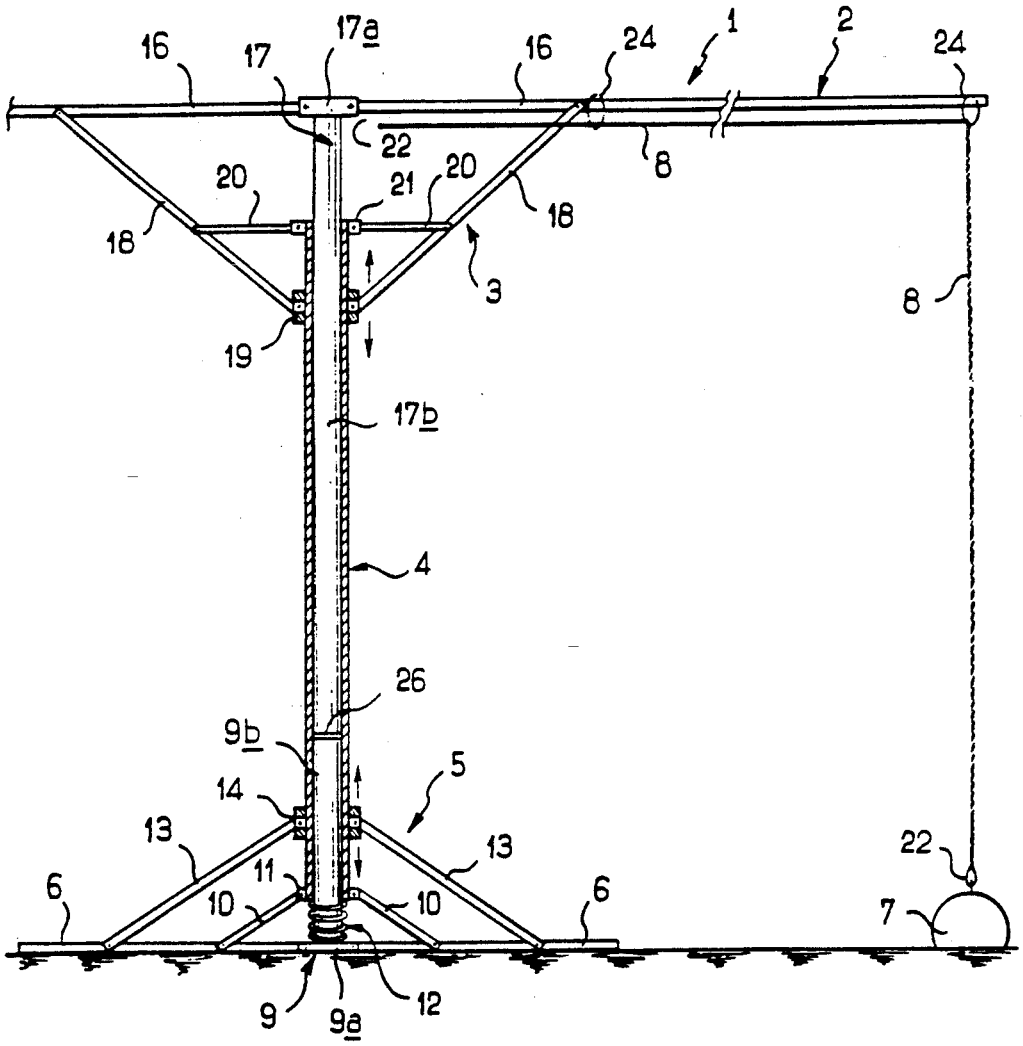
FIG. 4 shows the ensemble of the shelter of FIG. 1 with its ballasting device and in an unfolded state.

According to the conception envisaged for the use of retractable brace 3 of market shelter 1 of the present invention, ribs 16 are supported by a double system of rodding, such as that illustrated in FIG. 4.

Brace 3 is formed of ribs 16 jointed on head **17*a* provided for at the upper extremity of telescopic ferrule 17 placed at the upper extremity of pole 4. Moreover, ribs 16 are supported by jointed rods 18 mounted between ribs 16 and a ferrule 19 sliding along pole 4**.

The support of rods 18 is assured by small rods 20 which are mounted and jointed to one extremity on the central part of rods 18 on which they lean and which are jointed to the other extremity on the upper extremity of pole 4, around joint connection 21.

The unfolding of brace 3 is obtained by making ferrule 19 slide towards the top along pole 4 which provokes the rotation of small rods 20 and rods 18, and consequently the unfolding of ribs 16, accompanied by a movement of re-entry of shaft **17*b* from telescopic ferrule 17 into pole 4**.

Thus, according to the present invention, in contrast to existing systems which necessitate a significant force for opening the brace bearing the canvas, the structure advantageously allows facilitating the opening through the jointed system rods 18—small rods 20—ribs 16, aided moreover by lowering into tubular pole 4 the telescopic ferrule 17 which then plays a role of counterpoint.

After having penetrated into pole 4, shaft 17*b* of ferrule 17 comes into abutment on shaft 9*b* of ferrule 9, as shown in 26 on FIG. 4, which limits the unfolding of the retractable brace. In order to avoid the descent of ferrule 19 after opening of brace 3, one immobilizes the relative transfer, either of ferrule 19 with regard to tube 4, or of ferrule 17 with regard to tube 4 by an appropriate means such as a transversal pin or other means (not shown).

In another method of use, one would also be able to envisage the bolting of the shelter in an unfolded position by a rod which would connect the top of the pole, and more precisely head 17*a* of ferrule 17, to the leg, and more precisely to the head 9*a* of ferrule 9 of the leg. The length of this bolting rod is defined naturally in accordance with the cases in order that the two ferrules 9 and 17 come into abutment in 26 in the interior of pole 4.

In the same manner as the leg, one would be able to envisage utilizing a pull-back device, eventually overtaking the neutral point in the system of opening of brace 3 in order to facilitate the handling. Any known device such as a spring, a jack, could be employed in this regard.

One can advantageously equip the brace of a device avoiding in periods of strong wind the canvas from turning inside out. According to the invention, this device includes ballasts 7 suspended, in a detachable manner, by the intermediary of snap-hooks 22 to the extremity of shrouds 8.

Shroud 8 is advantageously used produced by a shaft or a rigid tube linked together to the extremity of all or some of ribs 16. Moreover, around this rib an eyelet-hole 24 is provided for which allows, after having unlinked ballast 7 at the level of snap-hook 22, placing shroud 8 in a position noticeably parallel to the rib, as the line in dash marks in FIG. 4 shows. Thus, before the folding of the shelter of the present invention, one places shroud 8 in such a way that snap-hook 22 comes to the level of the center of the structure of the roof. The maintaining of the shroud can be realized thanks to eyelet-hole 24 which contributes to a slot at the level of the rib.

The shelter can afterwards be folded and, during this folding, eyelet-hole 24 leaving the slot slides along rib 16 in order to come back by its weight towards the bottom of the rib. Shroud 8 is maintained by the folded structure but, during a new unfolding of the structure, the shroud comes back naturally into a vertical position without complementary handling for a new use.

What is claimed is:

1. A foldable shelter such as a parasol, market shelter, camping shelter or similar apparatus, designed especially to protect a surface on the ground against bad weather, sun or rain, which comprises a roof supported by a foldable brace, a pole supporting said roof and said foldable brace, and a foldable foot comprising ground-engaging radial branches each pivoted at their inner end to a ground-engaging central member vertically movable with respect to said pole and each connected to said pole by coupling links pivoted at their respective ends to said branches and to said pole, whereby, upon engagement of said ground-engaging central member with the ground, with said pole being substantially in a vertical position, the combined weight of said pole, roof and brace causes said pole to move downwardly with respect to said central member to unfold said foot and to thereby put said radial branches into a shelter-supporting unfolded position.

2. The foldable shelter as recited in claim 1, further comprising means for biasing said foot to a folded closed position against said pole.

3. The foldable shelter as recited in claim 2, wherein said biasing means comprises a compression spring disposed between said pole and said central member, said spring being adapted to have a force sufficient to fold said foot but lower than said combined weight.

4. The foldable shelter according to claim 1, wherein said central member forms the lower end portion of a rod axially movable within said pole, the latter being formed by a tube.

5. The foldable shelter of claim 4, wherein said spring is disposed around said rod.

6. The foldable shelter according to claim 4, wherein said brace comprises a central rod axially movable within said pole and the lower end of which is adapted to axially abut against the upper end of said rod.

7. The foldable shelter of claim 1, wherein said brace comprises: radial ribs each pivoted at their inner end to an upper central member vertically movable with respect to said pole and each connected to said pole by main coupling links pivoted at their respective ends to said ribs and to a sleeve slidably mounted on said pole; and auxiliary coupling links pivoted at their respective ends to said pole, at the upper end thereof, and to said main coupling links, respective.

8. Shelter according to claim 7, characterized by the fact that a ballasting device of the retractable brace (3) is formed of removable ballasts (7), suspended at the extremity of rigid shrouds (8) connected to the extremities of ribs (16), an eyelet-slot (24) surrounding each corresponding rib (16), apt to slide along said rib to bring shroud (8) noticeably parallel to the rib.

* * * * *